United States Patent [19]

Shinmoto

[11] Patent Number: 5,046,422

[45] Date of Patent: Sep. 10, 1991

[54] INK REMOVING SYSTEM FOR AN OFFSET PRINTING MACHINE

[75] Inventor: Takahiko Shinmoto, Hiroshima, Japan

[73] Assignee: Ryobi Ltd., Hiroshima, Japan

[21] Appl. No.: 372,144

[22] Filed: Jun. 27, 1989

Related U.S. Application Data

[63] Continuation-in-part of Ser. No. 144,719, Jan. 14, 1988, which is a continuation of Ser. No. 844,045, Mar. 25, 1986.

[30] Foreign Application Priority Data

Mar. 26, 1985 [JP] Japan ..... 60-44093[U]

[51] Int. Cl.[5] ..... B41F 35/00; A46B 15/00

[52] U.S. Cl. ..... 101/425; 15/256.51

[58] Field of Search ..... 101/169, 423, 425

[56] References Cited

U.S. PATENT DOCUMENTS

| | | | |
|---|---|---|---|
| 1,576,599 | 3/1926 | Goulding | 101/425 |
| 2,731,916 | 1/1956 | Koch | 15/256.51 |
| 2,970,541 | 2/1961 | Gegenheimer | 101/425 |
| 2,985,103 | 5/1961 | Roozee | 101/425 |
| 3,911,813 | 10/1975 | Schaeffer | 101/43 |

FOREIGN PATENT DOCUMENTS

| | | | |
|---|---|---|---|
| 1200839 | 9/1965 | Fed. Rep. of Germany | 101/425 |
| 381715 | 10/1964 | Switzerland | 101/425 |

*Primary Examiner*—Edgar S. Burr
*Assistant Examiner*—Kimberly L. Ashen
*Attorney, Agent, or Firm*—Sughrue, Mion, Zinn Macpeak & Seas

[57] ABSTRACT

An ink removing system for an offset printing machine utilizes a pair of cleaning tank mounting guides secured to left and right side frame walls of the printing machine having recesses therein facing each other. A cleaning tank is provided with a pair of axially detachable mounting pins projecting symmetrically longitudinally of the cleaning top to opposite sides thereof and engaged within the recesses for rotatably mounting the tank. A cam shaft rotatably supported by the vertical frame walls carries cams operatively engaging bracket mounted adjusting screws functioning as cam followers on the cleaning tank and engaging the periphery of the cams such that rotation of the cam shaft rotates a vertically projecting cleaning blade fixed to the cleaning tank and to edge contact with the periphery of the ink roller for cleaning of the same. Rotation of the cam shaft is limited to high and low can positions corresponding to blade contact with the ink roller and displacement laterally to the side thereof.

7 Claims, 5 Drawing Sheets

1
2
2a
2b
5
6
6a
7
8
9
10
10a
10b
11
12
13
14
15
15a
16
17
18
19
20
20a
20b
20c
21
21a
21b
22
22a
22b
23
24
25
26
27
28
29
30
35
36
37
116
a
b
II
IV

INK REMOVING SYSTEM FOR AN OFFSET PRINTING MACHINE

This is a continuation-in-part of application Ser. No. 07/144,719, filed 1/14/88 abandoned which is a continuation of application Ser. No. 06/844,045 filed 3/25/86 now abandoned.

FIELD OF THE INVENTION

This invention relates to an ink removing system for an offset printing machine, and more particularly, to a structural assembly for detachably mounting a cleaning tank between laterally spaced right and left printing machine frame walls for rotation about a vertical axis and an associated cam mechanism for camming the pivotable tank to cause a cleaning blade to make edge contact with the periphery of an ink roller.

BACKGROUND OF THE INVENTION

In offset printing machines, satisfactory prints may be obtained by satisfactorily cleaning the ink roller of ink or dust and by uniformly supplying a suitable quantity of ink to the plate surface through the ink roller. Accordingly, it is essential to insure that the roller is sufficiently clean of ink or dust.

A variety of ink removing systems are employed in offset printing machines. However, the conventional systems are designed so that the operator sets the cleaning tank, and more particularly, the plate projecting from the tank in edge contact with the periphery of the ink roller by rotation of adjusting screws or the like engaging the tank, by hand manipulation and hand contact with the tank. Hand contact is disadvantageous. The removal of the cleaning tank becomes an intricate operation, thus taking considerable labor and time.

Accordingly, it is, therefore, an object of the present invention to provide an improved system for ink removal of an offset printing machine which eliminates the above-described difficulties accompanying conventional ink removing systems for an offset printing machine by providing an ink removing system in which the cleaning tank may be readily installed, removed or set with respect to the ink roller by operating a single cam shaft, and wherein the contact pressure of the tank cleaning blade against the ink roller may be readily adjusted by the utilization of a cam or cams secured to the cam shaft.

SUMMARY OF THE INVENTION

The present invention is directed to an ink removing system for an offset printing machine having an ink roller mounted for rotation about its axis horizontally between a pair of parallel vertical frame walls. A pair of cleaning tank mounting guides are fixedly secured to the vertical frame wall, respectively, and facing each other and to one side of the ink roller. An elongated, rectangular, vertically upwardly open cleaning tank carries a pair of axially displaceable mounting pins or plungers projecting away from the tank and to opposite ends thereof, the mounting pins being carried in horizontal cylindrical bores and spring biased into outwardly projected position, held by stops integrated to pin holders at the end walls of the cleaning tank. Recesses, sized slightly larger than the diameter of the mounting pins, are carried within the ends of the tank mounting guides facing the cleaning tank interposed therebetween, such that, by displacing the mounting pins against their spring bias towards the cleaning tank, the cleaning tank carrying the mounting pins may be inserted between the vertical frame wall and upon release of the mounting pins, the ends of the pins are detachably engaged within the recesses of the mounting guides with the tank supported for rotation about the axes of the mounting pins.

A cam shaft is rotatably mounted for rotation within and extending between the vertical frame walls and in juxtaposition to the cleaning tank, and supports one or more radial cams engaging the cleaning tank or an element carried thereby. A cleaning blade projects outwardly of the cleaning tank at the open top thereof, extends longitudinally across the cleaning tank, and has an outer edge parallel to the ink roller for contact with the ink roller periphery. The axis of rotation of the cleaning tank defined by the pair of mounting pins is such that the tank tends to rotate by gravity to a position where the edge of the cleaning blade is spaced from the periphery of the ink roller. A manually rotatably handle fixed to one end of the cam shaft cause the at least one radial cam, in operative engagement with the cleaning tank, to cam the cleaning tank about its axis of rotation a defined by the pair of mounting pins, to place the edge of the cleaning blade in contact with the periphery of the ink roller to facilitate cleaning of the ink roller.

Brackets may be fixedly mounted to respective end walls of the cleaning tank, each having a cylindrical pin mounting hole opening outwardly along the axis of the bracket, and slidably receiving a mounting pin. Further, each bracket may comprise a radial slot over a portion of its length intermediate of the ends of the bracket, and each mounting pin may carry a right angle radially projecting knob which extends through the radial slot for manual grasping exterior of the bracket. A compression coil spring is interposed between the inner end of each mounting pin and the bottom of its mounting hole, slidably receiving the mounting pin so as to bias the knobs against the bracket wall at the end of the radial slot remote from the compression coil spring, with the end of the mounting pin projecting some distance beyond the end of the mounting bracket remote from the tank.

The pressure exerted by the at least one cam and through the tank to press the edge of the cleaning blade, fixedly mounted thereto, onto the periphery of the ink roller, may be adjusted by a pressure adjusting screw threadably supported on a bracket fixed to the tank with the threaded end of the adjusting screw contacting the periphery of the radial cam. Preferably, a pair of radial cams are fixed to the cam shaft at longitudinally spaced positions outwardly of the end walls of the tank and brackets fixed to the ends walls and projecting outwardly therefrom threadably mounting an adjusting screw carried by a tapped hole within the bracket. Lock nuts may be mounted to the projecting ends of the adjusting screws for locking the adjusting screws at axially adjustable positions to set the pressure exerted by the cams through the cleaning blade on the periphery of the ink roller. A collar fixedly mounted on the cam shaft and carrying a radially projecting limit pin, limits rotation of the cam shaft between two positions defined by stops fixedly mounted to the vertical frame wall adjacent the rotatable cam shaft and in the path of rotation of the limit pin projecting radially from the collar. The opposite end of the cam shaft may include a reduced diameter portion which is rotatably received within a correspondingly sized hole within the vertical frame wall. The reduced diameter portion of the shaft acts in conjunction with the laterally spaced vertical frame wall to prevent axial shifting of the cam shaft, in one direction while the collar limits axial movement in the other direction. The projecting limit pin 26 on the cam shaft limits rotation of the cam shaft between positions where the projecting pin 26 contacts the two stops carried by the vertical frame wall proximate to the shaft collar. The angle of rotation preferably corresponds to the low and high points on the radial cams. An operating lever or handle is fixedly mounted to an end of the cam shaft projecting through one of the vertical frame walls so that contact and release of the cleaning blade with the ink roller may be effected at a location external from the machine frame.

DESCRIPTION OF THE PREFERRED EMBODIMENT

Figure 1:
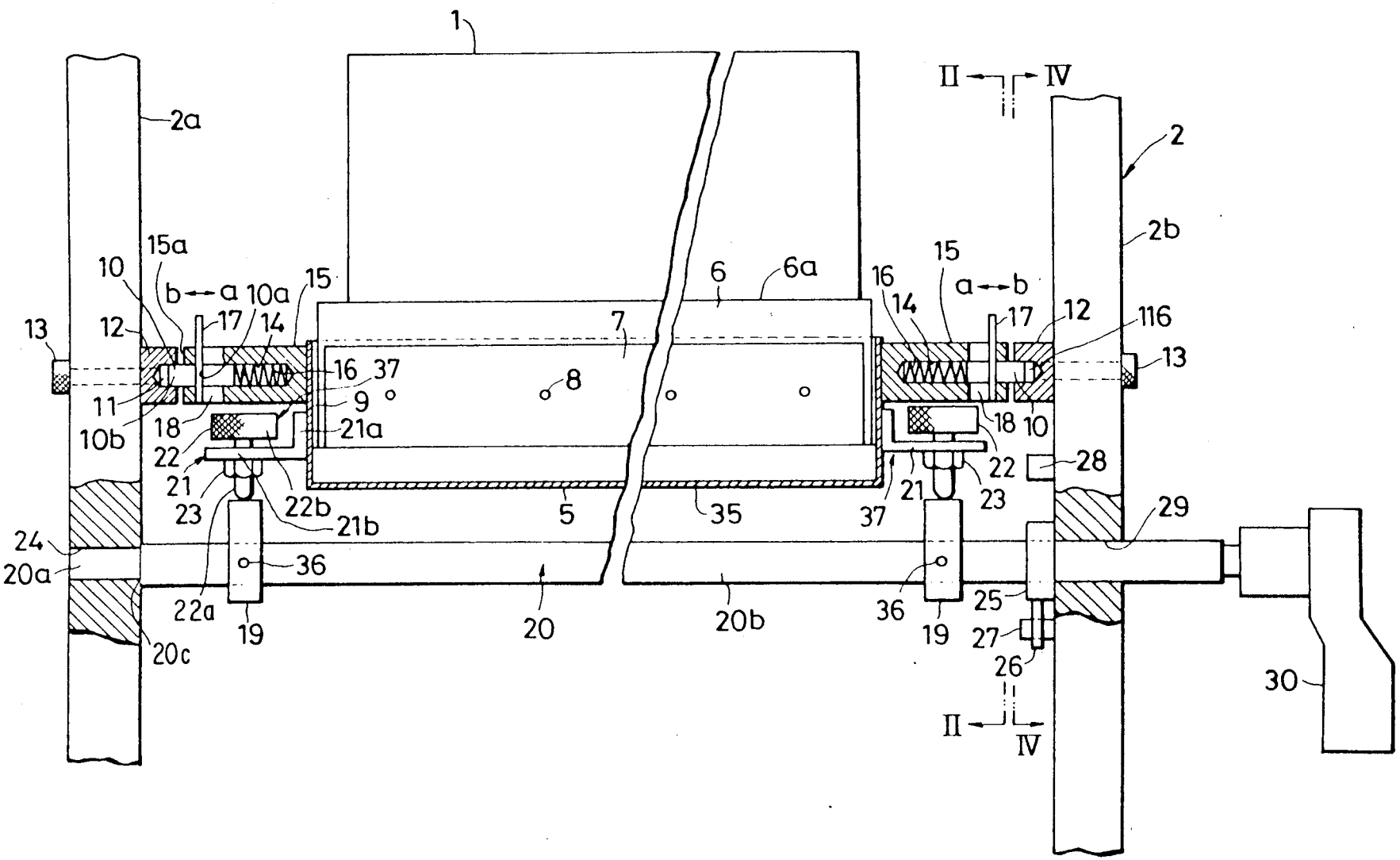
FIG. 1 is a front elevational view of an offset printing machine incorporating the ink removing system forming a preferred embodiment of the present invention, with portions thereof cut away and partially in vertical section.

One embodiment of the invention will be described with reference to the accompanying drawings.

As shown in FIGS. 1 through 4, an ink roller 1 is mounted for rotation about a horizontal axis by means (not shown) between laterally spaced vertical frame walls 2*a*, 2*b* of a frame indicated generally at 2. The ink roller 1 is one of several rollers of the offset printing machine to which the ink removing system of the present invention has application. In that respect, all of the rollers are shown schematically including ink roller 1, inking roller 3, intermediate roller 4, plate cylinder 31 and rubber blanket cylinder 32. Such offset printing machines require additionally an impression cylinder (not shown) to the opposite side of the rubber blanket cylinder 32 from plate cylinder 31.

The rollers are rotatably mounted between the left and right frame vertical walls 2*a*, 2*b* so that ink transfers onto the intermediate roller 4 through a variety of rollers from an ink tank (now shown) and the ink is transferred subsequently onto the plate surface (not shown) of the plate cylinder 31, through ink roller 1 and the inking roller 3, all of which is conventional.

With respect to the ink removing system of the present invention for application to such offset printing machines, a cleaning tank 5 is disposed below ink roller 1, between the laterally spaced frame walls 2*a*, 2*b* of FIG. 2 and extending the full width of the ink roller 1, FIG. 1. The cleaning tank 5 is of the form of an elongated rectangular box, (being open at the top.) The cleaning tank 5 is formed of spaced parallel, vertical end walls 9 joined together by a rear wall 33, a parallel and opposed front wall 34, and is closed off at the bottom by a bottom wall 35. A cleaning blade 6 is positioned within the tank 5 and between end walls 9 and is of a length on the order of the length of the tank. It is secured through a retaining plate 7 to the rear wall 33 of the cleaning tank 5 via screws 8 or the like, in such a manner that the upper edge 6*a* projects outwardly of the open top of the cleaning tank 5. That edge 6*a* is beveled and extends parallel to the periphery of the ink roller 1. As will be seen, it is movable into contact with the periphery of the ink roller.

Figure 3:
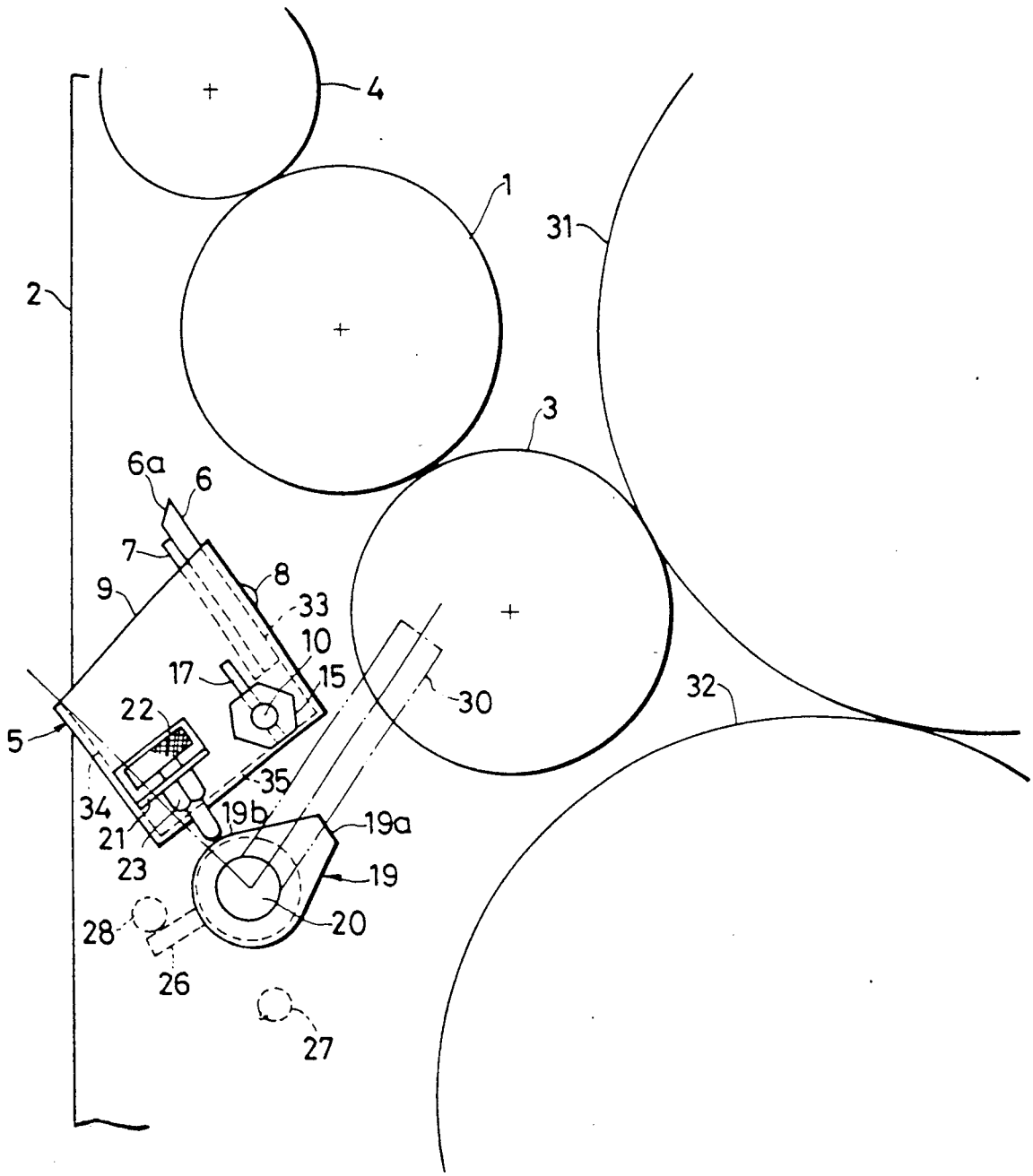
FIG. 3 is a similar vertical sectional view to that FIG. 2 as a result of rotation of the cam shaft approximately 90° to release engagement of the cleaning blade with the ink roller.

Hexagonal cross-section shaped brackets 15 are fixedly mounted to the exterior of the end walls 9 of the cleaning tank 5 and project outwardly thereof and are mounted adjacent the corners defined by bottom wall 35 and rear wall 33 of the tank, FIG. 3. The brackets 15 are each provided with an axial bore or pin mounting hole 14 within which is axially, slidably mounted a mounting pin 10. An elongated, narrow radial slot 18 is formed within the bracket intermediate of its ends, the slot 18 being proximate to the end 15*a* of the bracket 15 remote from the connection of the bracket 15 to the tank end wall 9. A compression coil spring 16 is mounted within each mounting hole 14 and is compressed between the bottom of the hole 14 and the inboard end of the mounting pin 10. Further, an operating knob 17 is fixedly carried by pin 10, extends through a small diameter hole 10*a* within that pin and projects through the radial slot 18 to the extent that one end of the knob 17 extends radially beyond the exterior of the bracket 15. The knob 17 is located axially on the mounting pin 10 at a position such that the outboard end 10*b* of the mounting pin normally projects axially beyond the outboard end 15*a* of its bracket 15.

Figure 4:
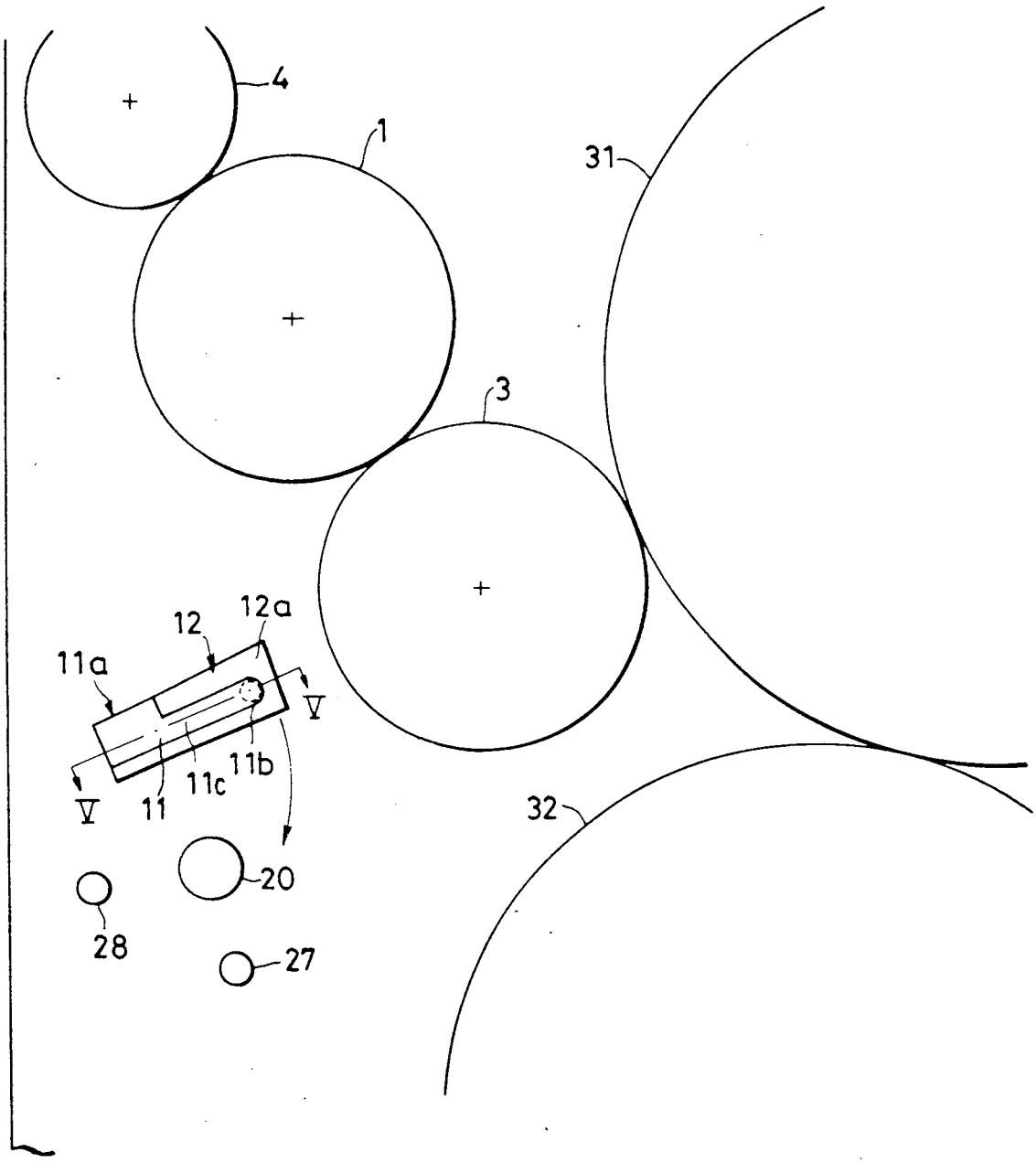
FIG. 4 is a vertical sectional view of the offset printing machine of FIG. 1 taken about IV—IV showing the mounting pin engaging recess within a tank mounting guide 12 for facilitating detachable mounting of the cleaning tank to the offset printing machine vertical frame walls.
Figure 5:
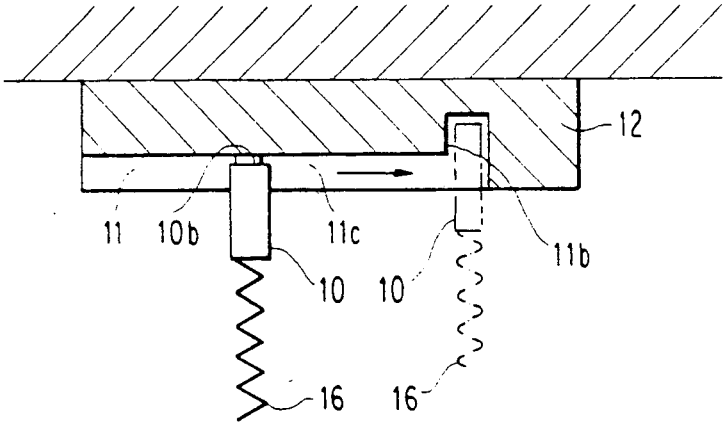
FIG. 5 is a sectional view of the tank mounting guide taken along the lines of V—V of FIG. 4.

Cleaning tank mounting guides or mounting blocks 12 are fixedly secured to the inner surfaces of the vertical frame walls 12*a*, 12*b* facing each other. The cleaning tank mounting guides or blocks 12 are of elongated rectangular form, FIG. 4, and are fixed to the vertical frame walls 2*a*, 2*b* by mounting screws 13 which project through the vertical frame walls 2*a* and 2*b* from the exterior of the machine and threadably engage the guides 12. Further, as seen in FIG. 4, within the vertical side faces 12*a* of the cleaning tank mounting guides or blocks 12 which face towards each other, there is provided a substantially L-shaped engaging recess 11 including a corner portion 11*a* which opens to the top of the obliquely mounted guides 12 and to one end thereof. A right angle near horizontal positioning portion 11*b* extends longitudinally away from the upwardly open portion 11*a* towards the opposite end wall and terminate short thereof. The mounting guides or blocks 12 incline rearwardly and downwardly with recess portion 11*b*.

As may be appreciated, the L-shaped engaging recesses 11 are so configured that the ends 10*b* of the pins 10 are permitted to ride within the L-shaped engaging recesses 11 by being dropped downwardly through the upwardly open portion 11*a*, and slid along the recesses 11 toward the recessed positioning portion 11*b*. Finally the ends 10*b* of the pins engage with the recessed positioning portions 11*b*, portions 11*b* being slightly wider than the diameter of the pins 10, whose ends 10*b* are received therein.

Importantly, the thickness of the tank mounting guides or blocks 12, the length of the brackets 15 and the length of the tank 5 along with the projectable displacement of the pin 10 from the end of bracket 15 are such that by manually displacing the knobs 17, FIG. 1, towards each other, the pin ends 10*b* are retracted to positions where they are flush with the ends 15*a* of the bracket, permitting the tank to be dropped into a position where the brackets 15 are in line with and adjacent the tank mounting guides 12, and facing the side of the recess 11 at recess portion 11*a*. At this point, the knobs may be released, and the ends 10*b* of the mounting pins contact recess portions 11*a* under the bias of the compression springs 16 and may be slid along the recess positioning portions 11*b*. As the tank assembly is pushed in the direction of the opposite end of the mounting guide 12 (i.e. away from the upwardly open portion 11*a*), the pin ends 10*b* slide along the engaging recess portions 11*b* of the oblique mounting guides 12 to the opposite ends thereof as seen in FIG. 4.

Thus, the open end part 11*a* of each recess is relatively short in terms of the front to rear direction of the cleaning tank 5 while an oblique guide recess 11*c* which forms the rear end portion of the recess 11 is relatively long. The positioning parts 11*b* are shaped for receiving the pins 10 and are deeper than the oblique guide recesses 11*c*. A diameter of the positioning part 11*b* is slightly larger than that of the pin 10.

With the tank mounting guides 12 being obliquely oriented upwardly from the open end parts 11*a* to the positioning parts 11*b*, at a slight angle, the pin ends 10*b* may be slid along the bottom surface of the oblique guides recesses 11*c* while being urged by an elastic force of compression springs 16 and fixed to the positioning parts 11*b* of the recesses 11. Accordingly, the tank seeks a pivot position defined by the rear ends of the positioning parts 11*b* of the engaging recesses 11.

A further principal component of the ink removing system for the offset printing machine resides in cam shaft 20 which is rotatably supported at a position below the mounting guides 12 on the left and right frames 12*a*, 12*b*. The cam shaft 20 is of a length in excess of the distance between the vertical frame walls 2*a*, 2*b* and the left end of the cam shaft includes a reduced diameter portion 20*a* which rotatably fits a relatively small diameter hole 24 within the left side vertical frame wall 2*a*. The cam shaft 20, over most of its length, has a larger diameter portion 20*b* sized slightly smaller than the diameter of hole 29 within right side vertical frame wall 2*b* through which the cam shaft 20 projects, from right to left. As such, a shoulder 20*c* is formed at the junction of the small and larger diameter portions 20*a*, 20*b* which locates the cam shaft 20 and prevents the cam shaft 20 from moving to the left. The cam shaft 20 carries a pair of radial cams 19 at longitudinally spaced positions fixed thereto by set screws or the like 36. The larger diameter portion 20*b* of the cam shaft carries a collar 25 which is fixedly mounted on the cam shaft 20, adjacent the right side vertical frame wall 2*b* to prevent axial movement of the cam shaft 20 to the right. A limit pin 26 extends radially from collar 25. A pair of stops 27, 28 are fixedly mounted on the inner surface of vertical frame wall 2*b* and project into the path of rotation of pin 26. This limits rotation of the cam shaft through an angle ($\alpha$) FIG. 2.

Figure 2:
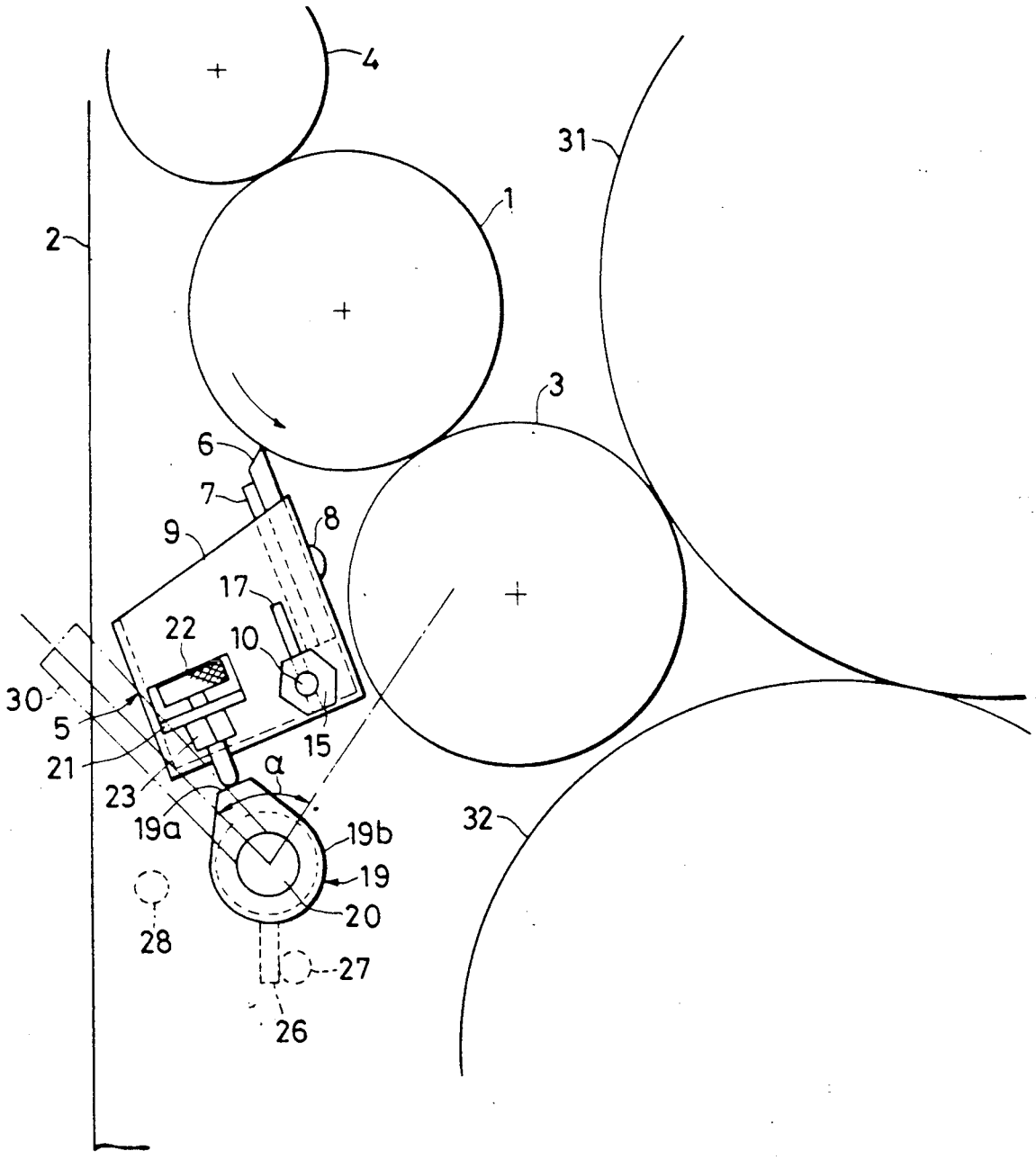
FIG. 2 is a vertical sectional view of the printing machine of FIG. 1, taken about line II—II, showing the cleaning tank rotated to cleaning blade contact position with the periphery of the ink roller by cam shaft rotation to high cam position.

As may be appreciated, by positioning the mounting pins 10 to the bottom and closer to the rear wall 33 than the front wall 34 of the cleaning tank 5, the cleaning tank 5 automatically pivots counterclockwise about the axis of pins 10, FIG. 2, by its own weight and therefore normally moves the edge 6*a* of cleaning blade 6 away from the periphery of the ink roller 1. The function of the cam rollers 19, as a result of rotation of the cam shaft 20, is to rotate the cleaning tank 5 clockwise and to tilt the tank rearwardly so that the cleaning blade moves upwardly and against the periphery of roller 1. A pair of cam follower mechanisms 37 are fixedly mounted to the exterior of the tank end walls 9. In that respect, pressure adjusting brackets of L-shaped configuration as at 21 are fixedly mounted on the ends walls 9 and projecting outwardly thereof. Portions 21*a* abut the exterior face of the sidewall 9, while right angle projecting portions 21*b* are essentially parallel to the bottom wall 35 of the tank. A pressure adjusting screw 22 is threadably engaged with and passes through end bracket portion 21*b* with the projecting end 22*a* of the adjusting screw in contact with the periphery of its radial cam 19. Stop nuts 23 are threaded to the ends 22*a* of the adjusting screws to permit locking of the adjusting screws at a given axially adjustable position after rotating horizontal head 22*b* thereof, resulting in the contact pressure of the cleaning blade 6 against the ink roller 1 being varied as desired.

Fixedly mounted to the end of shaft portion 20*b* is a radially projecting operating lever or handle 30 which may be manually operated to rotate the cam shaft between positions of engagement of limit pin 26 carried by collar 25 with stops 27 and 28. When the pin 26 engages stop 27, by rotation of the shaft counterclockwise from the position shown in FIG. 3, the ends 22*a* of the pressure adjusting screws 22 ride onto the tops 19*a* of the radial cams 19, the effect of which is to cause the edge 6*a* of the cleaning blade 6 to contact the periphery of the ink roller 1.

To the contrary, by rotation through angle ($\alpha$) (approximately 90°) to the position where limit pin 26 abuts stop 28, FIG. 3, the ends of the pressure adjusting screws 22 ride on the bottoms 19*b* of the cams 19 allowing gravity rotation of the cleaning tank 5, counterclockwise about its pivot axis as defined by pins 10, so that the tank falls forwardly and causes the cleaning blade 6 to move away from the roller 1. Thus, the cleaning blade 6 of the cleaning tank may be brought into and out of engagement with the ink roller 1 merely by turning the cam shaft via operating the handle or lever 30. Furthermore, the cleaning tank mounting guides 12 being secured to the left and right frames 2*a*, 2*b* and with their recesses facing upwardly at the insert end, the cleaning tank may be easily set onto the guides by means of the mounting pins by simply causing the knobs 17 to be moved against the spring bias of the coil spring 16 towards each other, then permitting the pin ends 10*b* to move out and engaging the sides of the guides at recessed portions 11*a* and thence be slid the longitudinally extending recess positioning portions 11*b* to seek the pin engagement position of the same. Additionally, the cleaning tank 5 maintains contact of the ends of the pressure adjusting screws with the cams 19, irrespective of the angulation of the cam shaft axis, limited by contact of pin 26 with the stops 27, 28.

Easily and expeditious adjusting of the contract pressure of the cleaning blade 6 against the ink roller can be accomplished by turning the knurled heads 22b of the adjusting screws.

As a result, the problems of conventional ink removing systems are solved by the provision of an improved ink removing system utilizing a pair of cleaning tank mounting guides secured to the left and right side frame walls of the printing machine with a pair of axially detachable mounting pins provided on the end walls of the cleaning tank, with the pins being extended symmetrically longitudinally of the cleaning tank and engaged within recesses formed within the mounting guides for positioning thereby. Further, by utilizing a cam shaft which is detachably supported by the laterally spaced vertical frame walls and being rotatable about its axis and having a number of cams thereon in operative engagement with the cleaning tank, the cleaning tank may be held in a predetermined posture with respect to the ink roller for effective engagement of the cleaning blade edge with the periphery of the ink roller. By manually adjusting the axial position of adjusting screws functioning as cam followers, the pressure exerted by the cleaning blade on the periphery of the ink roller may be varied.

While the invention has been particularly shown and described with reference to a preferred embodiment thereof, it will be understood by those skilled in the art that various changes in form and details may be made therein without departing from the spirit and scope of the invention.

What is claimed is:

1. An ink removing system for an offset printing machine, said offset printing machine including an inking roller mounted for rotation about its axis horizontally between a pair of parallel vertical frame walls, said system comprising:

a pair of cleaning tank mounting guides fixedly secured to the vertical frame wall, respectively, facing each other and to one side of said ink roller, an elongated rectangular, vertically upwardly open cleaning tank, means on opposed ends of said cleaning tank for supporting a pair of axially displaceable spring biased mounting pins projecting away from said tank and to opposite ends thereof, recesses sized slightly larger than the diameter of the mounting pins carried within the ends of the tank mounting guides facing said cleaning tank, said cleaning tank interposed between said mounting guides, with the axially displaceable pins being spring biased into contact with the mounting guides and received within said recesses, such that said tank is supported for rotation about the axes of said mounting pins, a cam shaft rotatably mounted for rotation between said vertical frame wall and parallel with said inking roller and in juxtaposition to and below the cleaning tank, said cam shaft carrying one or more radial cams operatively engaging said cleaning tank to a side of said tank pivot axis as defined by said mounting pins remote from said inking roller, a cleaning blade projecting outwardly from the top of said cleaning tank and extending longitudinally of said cleaning tank and having an outer edge parallel to said inking roller for contact with the inking roller periphery, an adjusting screw support bracket fixedly mounted to said tank and projecting across and facing the periphery of said at least one cam, an adjusting screw threadably projecting through said adjusting screw mounting bracket and having a threaded end in contact with the periphery of the radial cam such that adjusting said screw axially varies the pressure exerted by said at least one cam through said cleaning blade edge on the periphery of said inking roller, wherein the position of said mounting pins on said cleaning tank is such that said tank tends to rotate by gravity to a position where the edge of the cleaning blade is spaced from the periphery of said ink roller and to cause and maintain operative contact between said at least one radial cam and said cleaning tank; and wherein said cam shaft includes a reduced diameter portion at one end rotatably received within a correspondingly sized hole within said one of said vertical frame walls, the other end of said cam shaft projecting through a hole within the other of said vertical frame walls, a collar fixedly mounted to said cam shaft adjacent said other frame wall and forming a first stop to prevent axial shifting of said cam shaft, a shoulder defined by said reduced diameter portion of said cam shaft which abuts the face of said one vertical frame wall to prevent axial shifting of said cam shaft in that direction, and wherein a limit pin is fixedly mounted to said collar and extends radially thereof, and a pair of stops are fixedly mounted to said other frame wall and projects outwardly thereof and in the path of said radially projecting pin to limit rotation of said cam shaft between said first and second cam shaft positions in which said cleaning tank blade edge is in contact with the periphery of said ink roller and remote therefrom, and wherein the angle of rotation corresponds to low and high points on said at least one radial cam, whereby, rotation of said cam shaft causes said at least one radial cam, in operative engagement with said cleaning tank, to cam said cleaning tank about its axis of rotation and to place the edge of said cleaning blade in contact with the periphery of said inking roller to facilitate cleaning of said inking roller.

2. The ink removing system as claimed in claim 1, wherein brackets are fixedly mounted to respective end walls of said cleaning tank, each bracket having an axial cylindrical pin mounting hole opening outwardly of said bracket at the end of the bracket opposite to the end wall of said cleaning tank, said mounting pins being slidably mounted within the cylindrical hole of said bracket, each bracket comprising a radial slot over a portion of its length longitudinally interior of the bracket, and each mounting pin carrying a right angle radially projecting knob fixed to the mounting pin extending radially thereof and extending through the radial slot, and said spring biasing means comprising a compression coil spring interposed between said mounting pin and said bracket pin mounting hole for biasing said pin in projected position, and wherein said radially projecting knob limits projection of the end of the pin exteriorly of the pin mounting hole in the direction of the tank mounting guide recess receiving the end thereof; whereby, retraction of the spring biased mounting pins within said bracket cylindrical pin mounting hole against its compression coil spring permits the tank to be interposed between the tank mounting guide with the ends of the brackets facing the mounting guide recesses and release of the knob causes the spring biased mounting pins to project outwardly of the bracket ends and into the mounting guide recesses.

3. The ink removing system as claimed in claim 2, wherein said tank mounting guides have generally L-shaped recesses within the side thereof facing away from the vertical frame wall supporting the same, said L-shaped recesses having right angle portions including a first portion extending upwardly and opening to the top of said mounting guides, a second right angle portion extending rearwardly, an elongated oblique guide recess having a constant depth and a recessed portion which is deeper than said guide recess such that the mounting pins in dropping through the upwardly open portion of the recess, can be slid along said guide recess while being urged by an elastic force of a spring, said mounting pins becoming engaged in said recessed portion of said tank mounting guides to thereby fix the pivot axis for the cleaning tank.

4. The ink removing system as claimed in claim 3, wherein said bracket are fixed to the ends of the rectangular cleaning tank such that the tank rotates on the axis defined by the mounting pins in a direction away from the inking roller to displace the cleaning blade edge from the periphery of the inking roller.

5. The ink removing system as claimed in claim 1, wherein a radially projecting operating lever is fixedly mounted to the end of the cam shaft projecting through the other of said vertical frame walls, so that contact and release of the cleaning blade with the ink roller may be manually effected externally of the machine frame.

6. The ink removing system as claimed in claim 2, wherein said tank mounting guide recesses have an oblique positioning portion into which said spring biased mounting pins project during said release of said knob.

7. The ink removing system as claimed in claim 6, wherein said tank mounting guides have generally L-shaped recesses having a first right angle portion and a second right angle portion, said second right angle portion being provided with said oblique positioning portion adapted to receive therein said spring biased mounting pin biased by a compression coil spring, said cleaning tank being rotatable about a center of said spring biased mounting pin fitted in said oblique positioning portion by biasing force of said compression coil spring.

* * * * *